US010240310B2

(12) United States Patent
Ragsdale, Jr.

(10) Patent No.: US 10,240,310 B2
(45) Date of Patent: Mar. 26, 2019

(54) BERM OR LEVEE EXPANSION SYSTEM AND METHOD

(71) Applicant: Larry J. Ragsdale, Jr., Webster, TX (US)

(72) Inventor: Larry J. Ragsdale, Jr., Webster, TX (US)

( * ) Notice: Subject to any disclaimer, the term of this patent is extended or adjusted under 35 U.S.C. 154(b) by 0 days.

(21) Appl. No.: 15/603,834

(22) Filed: May 24, 2017

(65) Prior Publication Data

US 2017/0254037 A1 Sep. 7, 2017

Related U.S. Application Data

(63) Continuation-in-part of application No. 14/731,553, filed on Jun. 5, 2015.

(60) Provisional application No. 62/008,662, filed on Jun. 6, 2014.

(51) Int. Cl.

| | |
|---|---|
| ***E02B 3/10*** | (2006.01) |
| ***E02D 17/18*** | (2006.01) |
| ***E02B 3/12*** | (2006.01) |
| *E02D 5/02* | (2006.01) |

(Continued)

(52) U.S. Cl.

CPC ..... *E02B 3/10* (2013.01); *E02B 3/126* (2013.01); *E02B 3/122* (2013.01); *E02D 5/02* (2013.01); *E02D 5/80* (2013.01); *E02D 17/205* (2013.01); *E02D 2300/002* (2013.01); *E02D 2300/0006* (2013.01); *E02D 2300/0007* (2013.01);

(Continued)

(58) Field of Classification Search

CPC ..... E02D 17/18; E02D 7/06; E02D 3/10

See application file for complete search history.

(56) References Cited

U.S. PATENT DOCUMENTS

| | | | |
|---|---|---|---|
| 4,521,131 | A | 6/1985 | Nandlal |
| 5,605,416 | A | 2/1997 | Roach |
| 5,971,661 | A | 10/1999 | Johnson et al. |

(Continued)

FOREIGN PATENT DOCUMENTS

| | | | |
|---|---|---|---|
| JP | 2006045814 | | 2/2006 |
| JP | 2006045814 | A * | 2/2006 |
| WO | WO9739195 | | 4/1997 |

OTHER PUBLICATIONS

EPS Industry Alliance; Compressive Strength; Jun. 2013 (Year: 2013).*

(Continued)

*Primary Examiner* — Benjamin F Fiorello
(74) *Attorney, Agent, or Firm* — David McEwing

(57) ABSTRACT

A system and method to create or elevate a berm of a liquid retention facility by placement of lightweight liquid impervious. The system and method can also be used to elevate the liquid retention height of the berm in combination with impervious liner retention material. By constructing the berm system on an existing levee, the effective height of the levee can be increased. The lightweight fill material provides the shape of the berm or levee extension. The liquid impervious liner material provides a watertight surface, the media for joining of the lightweight fill material, and the anchoring of the lightweight fill material to the existing berm or levee structure. The system may use solid wall hollow body structures to elevate the berm. The system may also use lightweight frames to support the vertical elevation of a liner above the berm.

18 Claims, 17 Drawing Sheets

(51) Int. Cl.
*E02D 17/20* (2006.01)
*E02D 5/80* (2006.01)

(52) U.S. Cl.
CPC ..... *E02D 2300/0029* (2013.01); *E02D 2300/0079* (2013.01); *E02D 2600/30* (2013.01)

(56) References Cited

U.S. PATENT DOCUMENTS 6,012,872 A 1/2000 Perry et al.
6,079,904 A * 6/2000 Trisl ..... E02B 3/106 405/107
6,146,054 A 11/2000 Tessonneau
6,390,154 B1 5/2002 Hall
7,214,005 B1 5/2007 Davis
7,574,834 B2 8/2009 Murray
7,708,495 B1 5/2010 Antee
8,361,261 B2 1/2013 Van Fossen
8,376,657 B2 * 2/2013 Dudding ..... E02D 31/002 405/129.57
8,845,240 B2 * 9/2014 Dudding ..... B09B 1/00 405/129.45
2003/0156903 A1 8/2003 Wiseman et al.
2004/0047688 A1 3/2004 Clement
2004/0190993 A1 * 9/2004 Archer-Simms ..... E02B 3/102 405/110
2004/0234340 A1 11/2004 Cho et al.
2006/0280563 A1 12/2006 Glick
2007/0154265 A1 * 7/2007 Stauffacher ..... E02B 3/108 405/110
2008/0138155 A1 * 6/2008 Kelley ..... E02B 3/06 405/21
2008/0201931 A1 8/2008 West
2011/0135394 A1 6/2011 Dudding
2011/0206458 A1 8/2011 Jones et al.
2012/0219746 A1 * 8/2012 Powell ..... B32B 5/022 428/57
2012/0261414 A1 10/2012 Mann et al.
2013/0071188 A1 * 3/2013 Taylor ..... E02B 7/20 405/114
2013/0105475 A1 * 5/2013 Marshall ..... B65D 90/24 220/4.12
2013/0121768 A1 * 5/2013 Powell ..... E02D 29/02 405/114
2013/0200079 A1 8/2013 Mann et al.
2014/0369759 A1 * 12/2014 Lee ..... E02L 37/005 405/110
2015/0191888 A1 * 7/2015 Karsten ..... E02D 29/0233 405/262

OTHER PUBLICATIONS

Geotec Associates, Jack Fowler, Proposed Alternative For Raising Mississipp Levees Using Geotube Technology Developed Under The Corps of Engineers' Construction Productivity Research Program (CPAR), Nov. 1, 1996.
Fred Pinkard, Thad Pratt, Donald Ward, Tina Holmes, Julie Kelley, Landris Lee, George Sills, Eric Smith, Perry Taylor, Nalini Torres, Lillian Wakeley, Johannes Wilowo, Flood-Fighting Structures Demonstration and Evaluation Program: Laboratory and Field Testing in Vicksburg Mississippi, Jul. 2007, Coastal and Hydraulics Laboratory, US Army Engineer Research and Development Center, Vicksburg MS.
Bladder Dike MPE 20, https://containmentcorp.com/product/bladder-dike-mpe-20/.

* cited by examiner

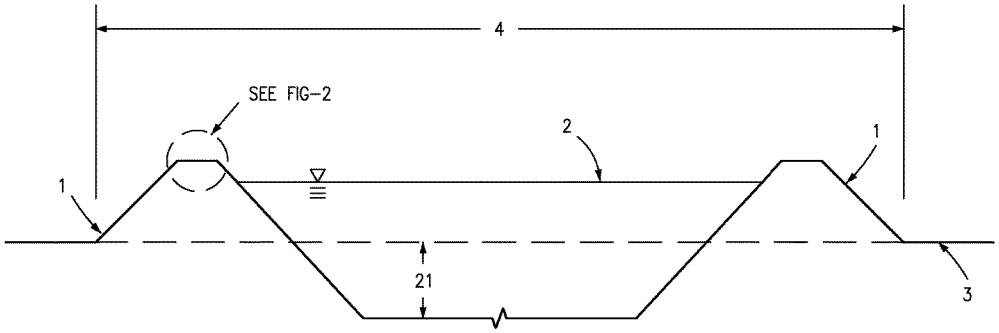
FIG-1 CROSS SECTION OF TYPICAL CONTAINMENT POND
PRIOR ART

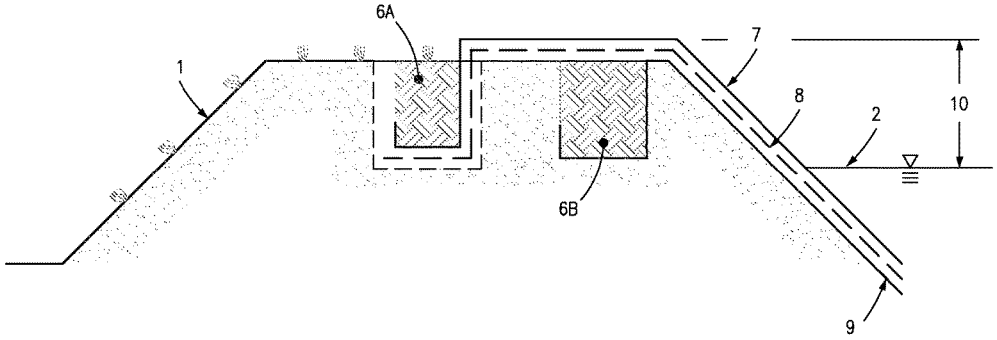
FIG–2 TYPICAL SECTION OF DOUBLE LINED LEVEE
PRIOR ART

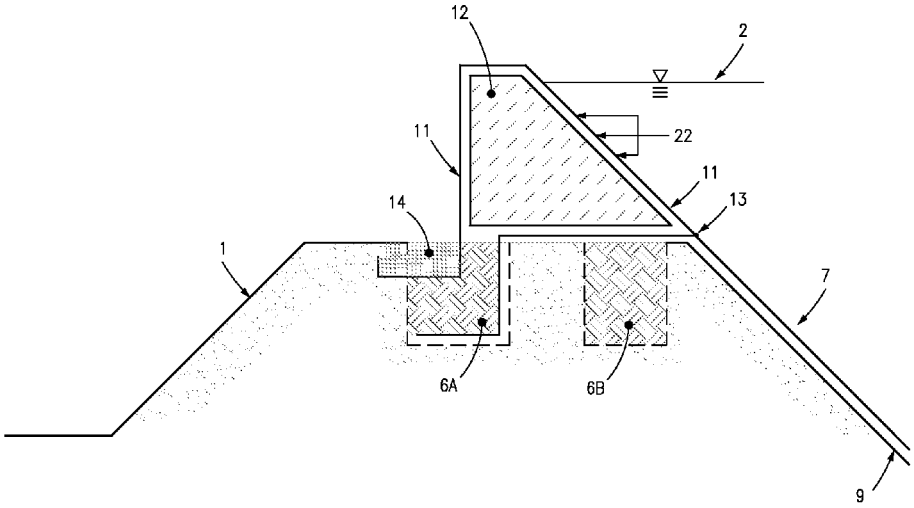
FIG-3 TYPICAL SECTION OF EMBODIMENT-A

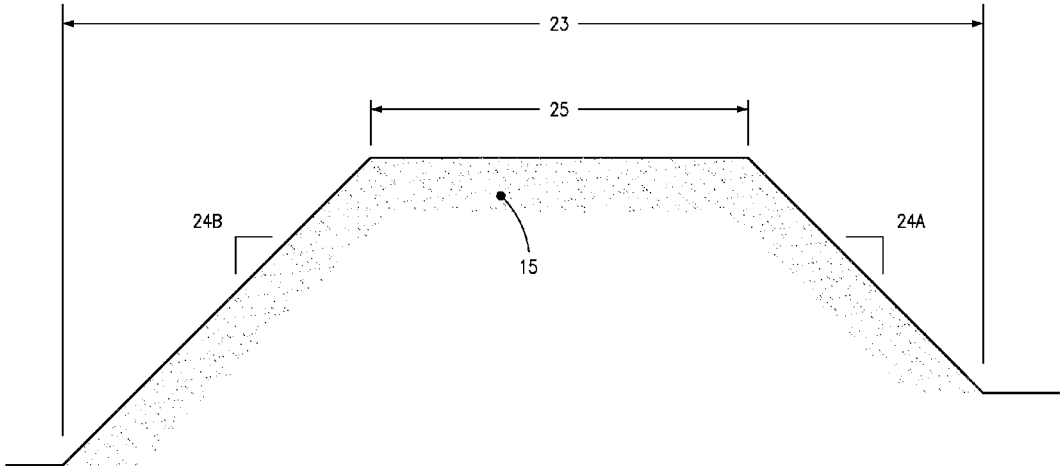
FIG-4 TYPICAL SECTION OF EXISTING EARTHEN LEVEE

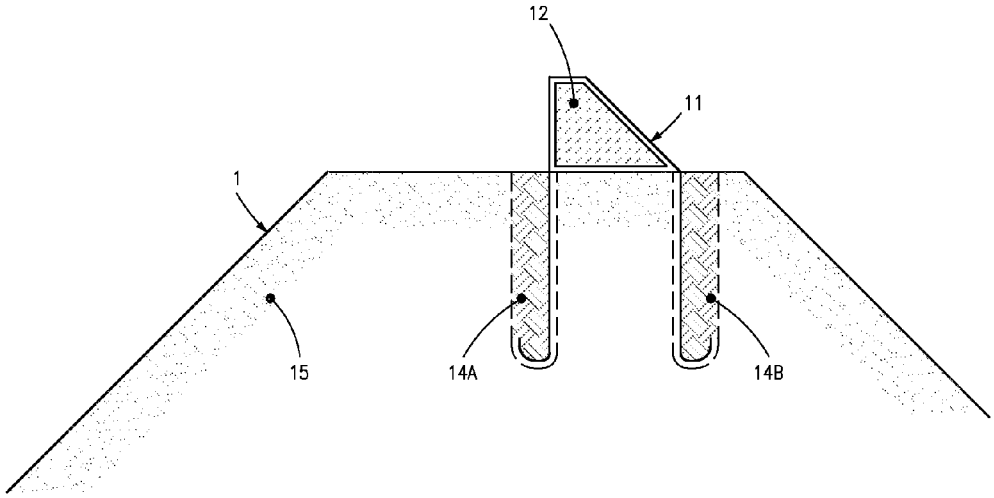
FIG-5 TYPICAL SECTION OF EMBODIMENT-B

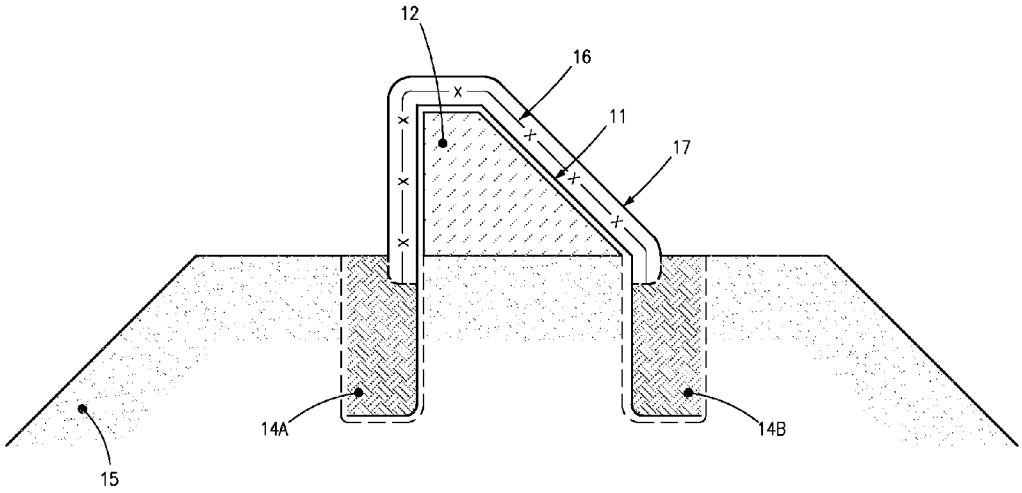
FIG-6 TYPICAL SECTION, EMBODIMENT-B, ARMORED

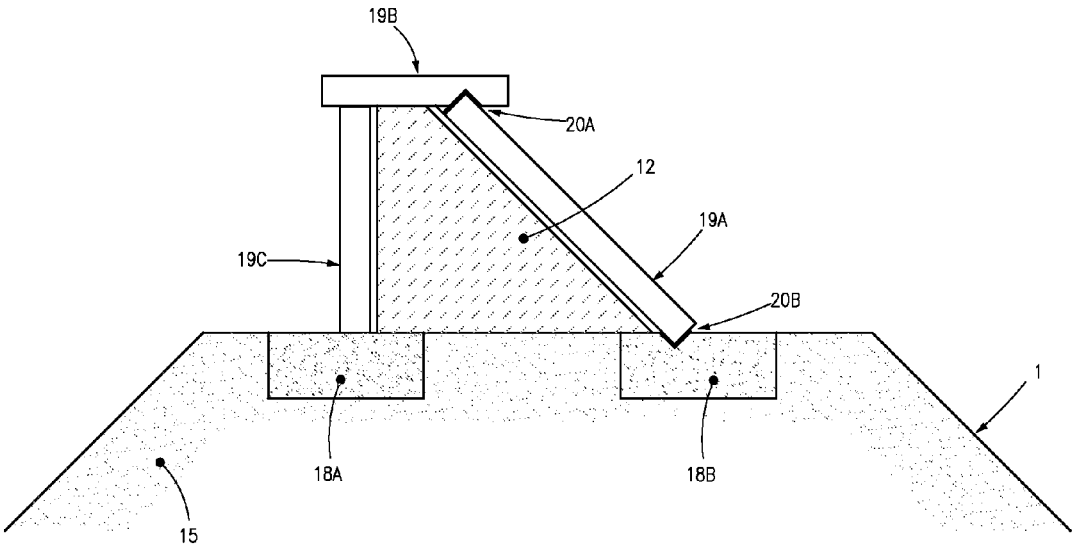
FIG-7 TYPICAL SECTION, EMBODIMENT-C, ARMORED AS LINER

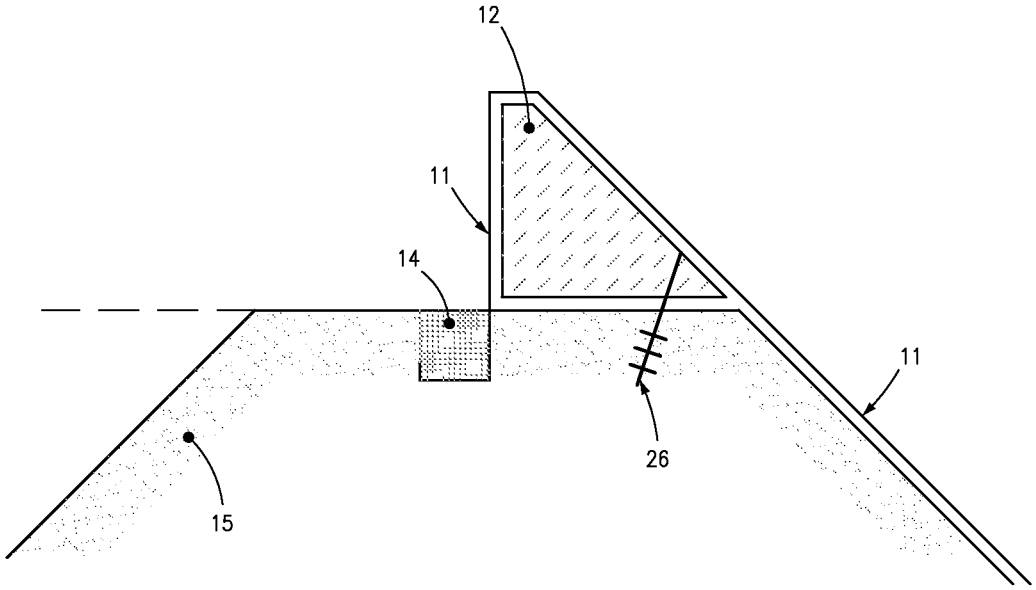
FIG-8 EMBODIMENT-D NEW LINER

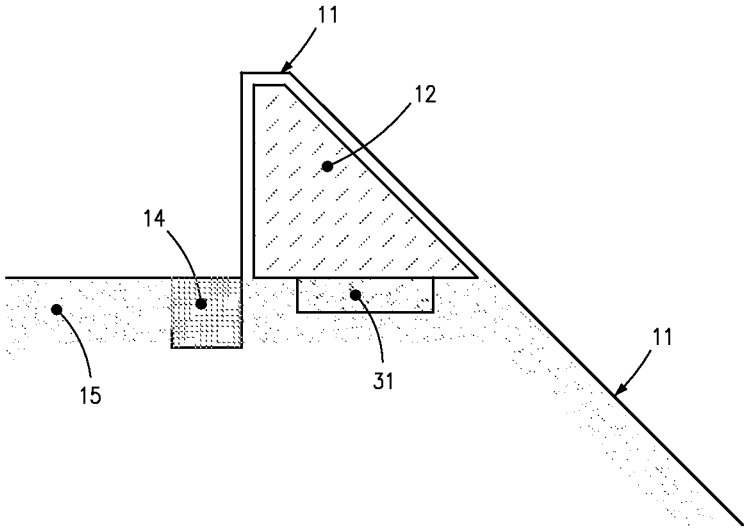
FIG-9 CONCRETE FOUNDATION

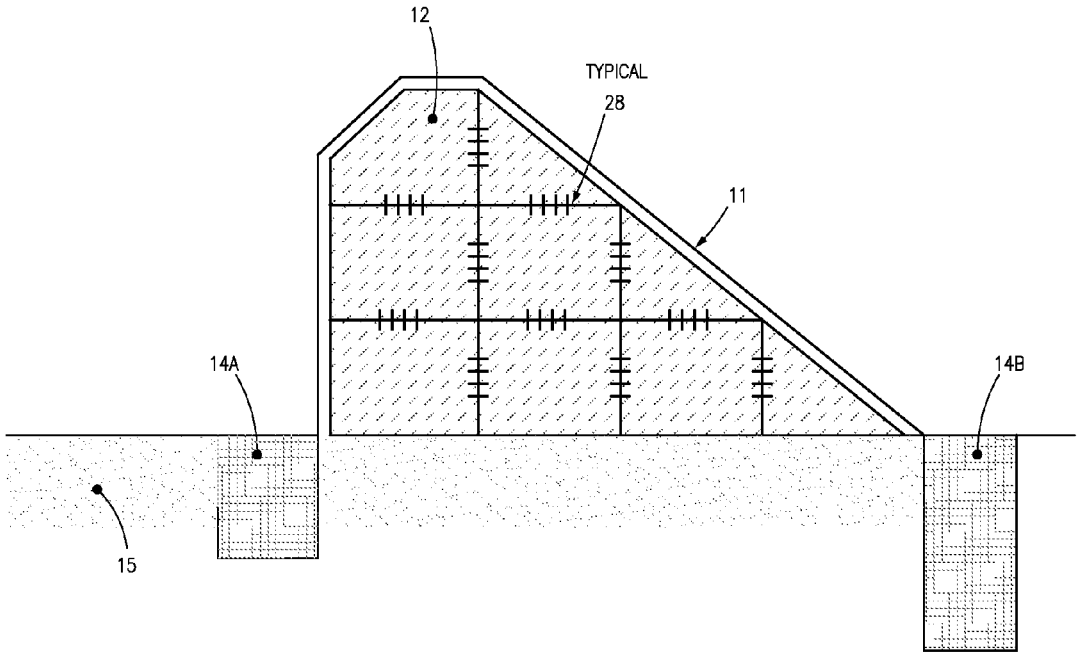
FIG-10 STACKED CONFIGRATION EMBODIMMENT-E

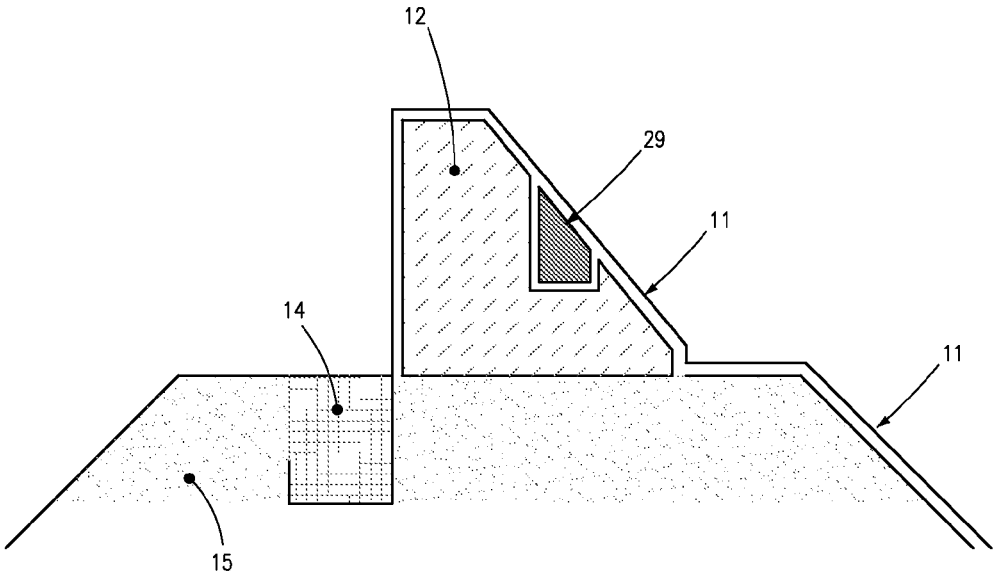
FIG-11 WEIGHTED SECTION, EMBODIMENT-F

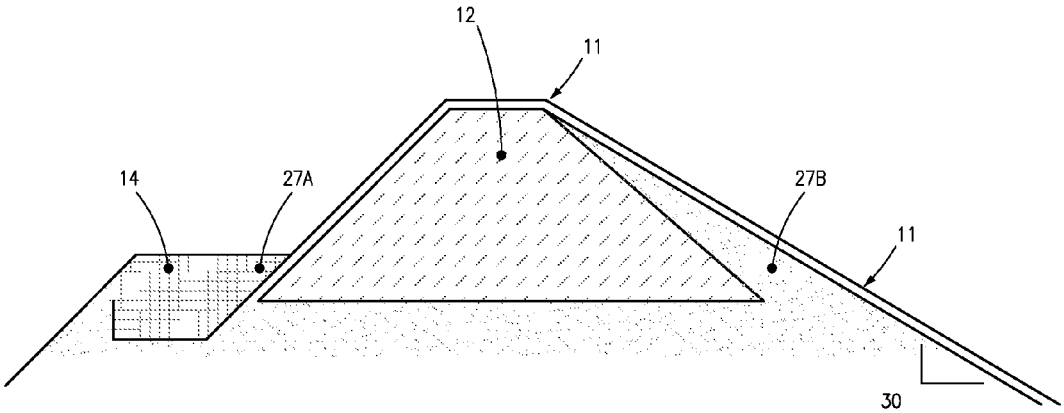
FIG-12 TWO SOIL ANCHOR POINTS

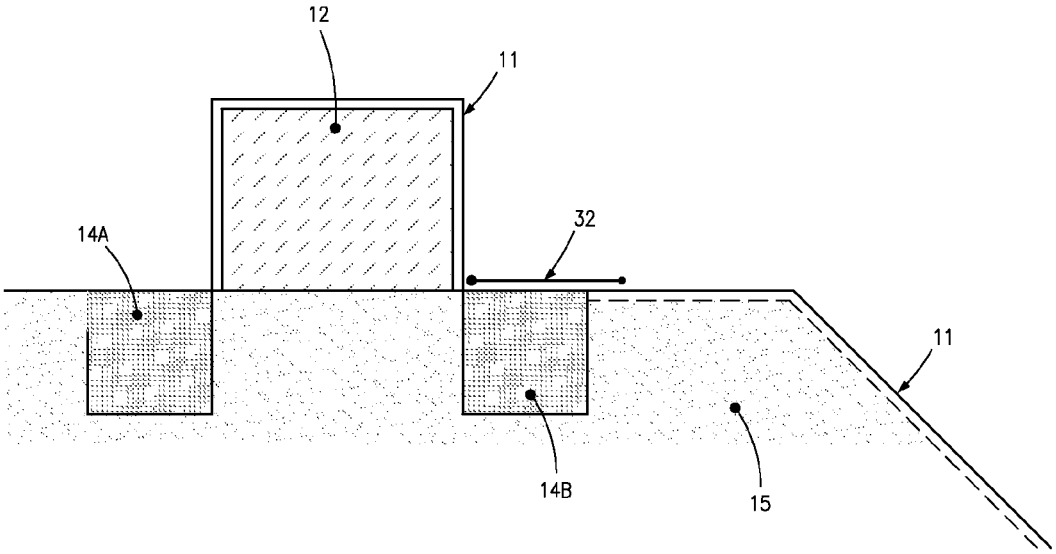
FIG-13 TWO ANCHOR TRENCHES

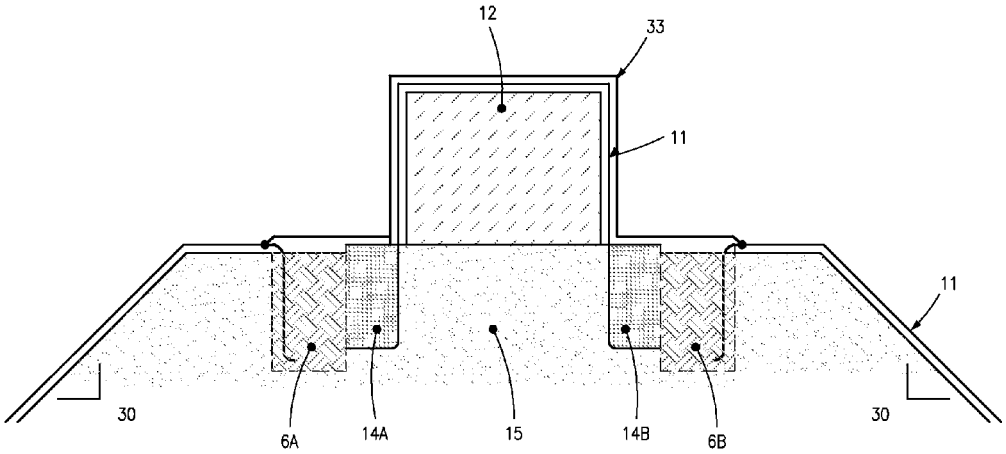
FIG-14 INTERIOR LEVEE (CONTAINED FLOUID ON BOTH SIDES)

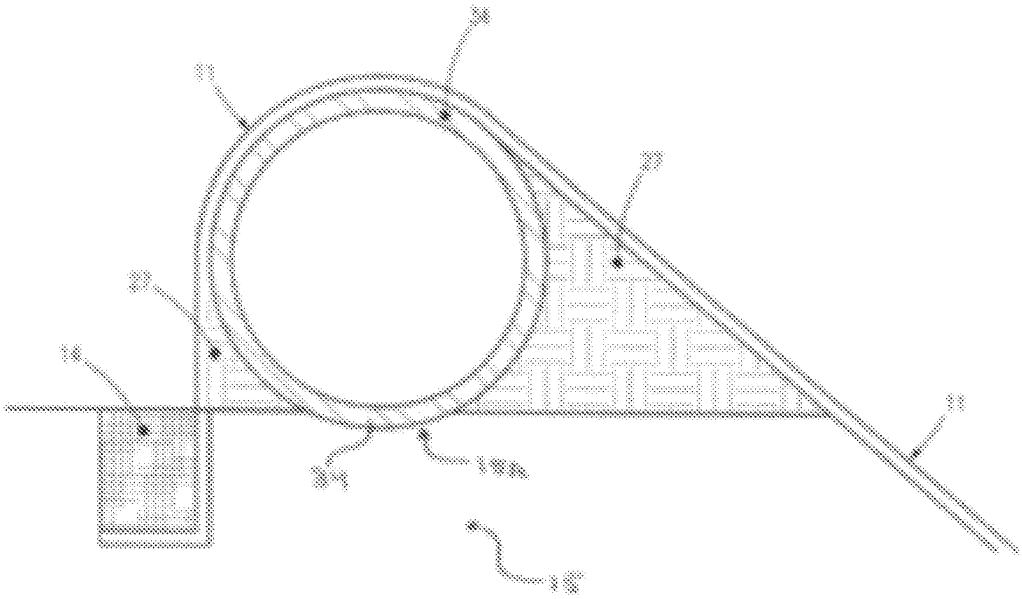
FIG-15 STRUCTURAL FILL

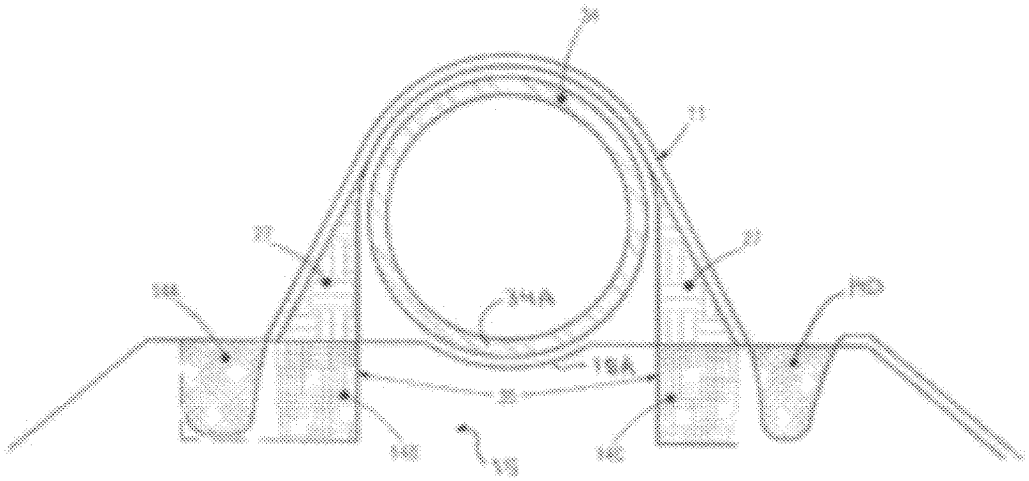
FIG-16 ANCHORED STRUCTURAL ELEMENT

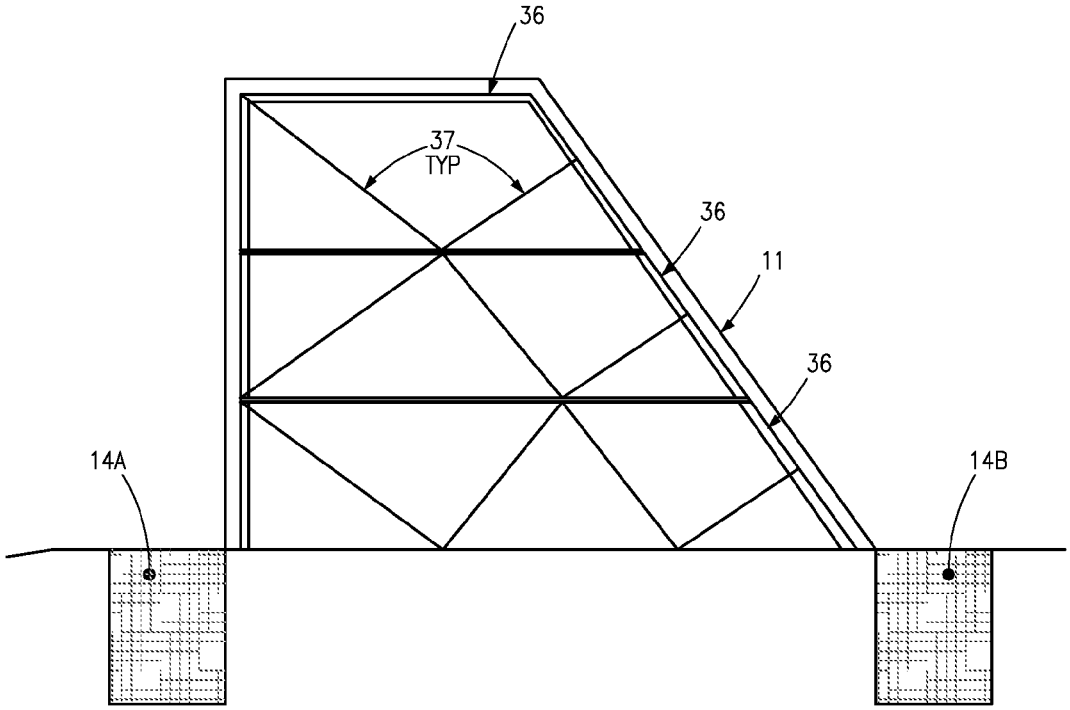
FIG-17 SOLID HOLLOW WALL WITH INTERNAL BRACING

BERM OR LEVEE EXPANSION SYSTEM AND METHOD

RELATED DOCUMENTS

This Application is a Continuation in Part of application Ser. No. 14/731,553 entitled "Berm or Levee Expansion System and Method" filed Jun. 5, 2015. The Ser. No. 14/731,553 application is incorporated herein by reference in its entirety. This Application also claims the benefit and priority to provisional application entitled "Berm or Levee Expansion System and Method, Application No. 62/008,662 filed Jun. 6, 2014. This provisional application is also incorporated herein by reference in its entirety.

1. Field of Use

The method and system of this disclosure pertains to economical expansion of capacity of liquid retention structures such as levees, retention ponds and similar structures. The expansion of capacity can be achieved with an expedited construction schedule.

2. Background of the Disclosure

Embankments are widely used in civil, industrial, and municipal applications for reservoirs for the retention and storage of fluids. As used in this disclosure, embankments, levees, retention dikes, dams and berms will collectively be referred to as berms. The fluids stored by these berms can range from storm water to hazardous materials such as fracking water or industrial process by-products. Industrial reservoirs are typically land-locked within existing facilities with little or no room to expand the reservoir in a horizontal direction due to adjacent structures, property owners, buried utilizes, etc. The need for additional reservoir volume capacity may occur for multiple reasons, including but not limited to expansions in process or treatment requirements. For the reasons described above, facility owners are faced with limited options to increase reservoir capacity.

One application of industrial reservoirs is the surface storage of brine solution at salt dome storage facilities. These facilities store hydrocarbon products in underground caverns that have been formed by dissolving salt deposits from naturally occurring salt dome formations. The brine solution is pumped underground to displace the hydrocarbon products out of the storage and into the facility for distribution to downstream facilities. When new product is pumped into the cavern, the brine is displaced through pipe systems to the surface storage reservoirs.

In the State of Texas, for example, regulations require an operating freeboard of 2 to 3 feet between the maximum operating fluid elevation and the top of the berm. Because this freeboard is by nature at the top of the berm and at the widest part of the levee (due to the sloping berm walls as described below), the storage lost to the freeboard requirement can be over 13% of the total available capacity of the reservoir. These reservoir are typically installed to utilize the maximum available footprint and cannot be easily expanded. Land restrictions make it difficult or impossible to add additional reservoirs. It is also expensive to remove and build a new berm wall constructed of soil.

Berms are also common in stationary flood control structures such as levees and dams. There are an estimated 100,000 miles of levees in the United States alone. It is sometimes necessary to raise the effective fluid retention height of these levees due to increases in upstream development that lead to increased runoff and therefore increased flood elevations. This is traditionally done by adding soil to the levee, constructing concrete barrier walls, or adding a gravity fill structure to the crest of the levee. These gravity fill systems rely on the weight of the added structure to resist the fluid pressures from the contained fluid.

SUMMARY OF THE DISCLOSURE

This disclosure teaches a method and system that can regain the pond storage lost or add pond storage by adding berm height and therefore the required freeboard capacity. In this regard, this disclosure can directly help America's energy delivery and storage systems. By simply adding 3-4 feet of berm height to multiple existing ponds, a significant increase in storage capacity can be realized.

In a broad aspect, the disclosure is directed to a fluid retention method and system. In one specific sense, the disclosure relates to raising the height of new or existing berms by installation of the proposed structure/system on top of an existing engineered berm. The method and apparatus of the disclosure pertains to erecting a structure consisting of a unique combination of lightweight fill material at least partially enclosed by an impervious fluid liner material. The fluid liner material will be attached to a new or existing liner positioned on the face of the berm, or otherwise be made impervious by anchoring into or against the existing structure. The proposed structure has no length limit. The lightweight fill structure can be installed around the full perimeter of the berm crest ground surface (the top of the berm surrounding an enclosed pond) or along the full length of a levee. The proposed system (impervious fluid liner and lightweight fill structure) effectively increases the height of the inner sidewall of a levee. This increased height may comprise a regulatory required freeboard for the berm structure, i.e., acting as a barrier only during temporary elevation of the fluid level in the retention pond, etc.

The method and apparatus of the disclosure also includes embodiments wherein the added structure may be a solid wall structure installed on the top of the berm, i.e., berm crest. This can be referred to as a berm height expansion apparatus. For example, the berm height expansion apparatus can comprise a hollow body solid wall structure. An example of such a structure is a hollow plastic pipe designed to convey liquids. The pipe can have diameters of 24 inches, 36 inches, etc. The pipe can be formed from high density polyethylene (HDPE), polyethylene, fiberglass, metal, e.g., steel, galvanized steel or aluminum, or concrete material, etc.

In an alternate embodiment, the berm height expansion apparatus may be a frame structure covered with a liquid impermeable liner. The frame structure does not comprise a solid wall. The frame can comprise aluminum, galvanized steel or steel. The cross sectional view of the frame structure may be a square, rectangle, triangle or similar geometric shape. The liner drapes over the frame structure and the liner is anchored with anchor trenches or bonding the liner to an existing liner as in previous embodiments, held in place by the frame structure that is anchored to the berm, retains the liquid within the pond. The frame holds the liner above the surface level of the berm, and thereby raising the liquid retention height.

The berm height expansion apparatus can be a solid wall, hollow body. The solid wall holds the liquid in the retention pond. The retention mechanism may be supplemented with the liquid impermeable liner. In another embodiment, the berm height expansion apparatus may comprise a frame structure. The frame structure does not have solid wall. Rather the frame structure holds the liquid impermeable liner above the surface of the top of the berm. The elevated liner serves to increase the liquid holding capacity of the liquid pond. The frame is lightweight and can be placed on a berm having a narrow base footprint. The berm height expansion apparatus allows increasing the pond holding capacity when it is otherwise not possible to elevate the berm by the addition of soil or other heavy material. Such circumstances include but are not limited to inadequate space to widen the base of the berm to permit increase the berm height, weakness of the berm foundation structure, or lack of access to the berm for earth moving equipment.

The unique combination of materials creates a system that can be installed where traditional earthen, sheetpile, or concrete structures are not feasible or cannot be constructed due to physical limitations such as equipment access, geotechnical concerns, or other constraints.

The lightweight fill material may be comprised of Expanded Polystyrene (EPS), commonly referred to as Geofoam®, or a similar lightweight rigid foam plastic material. Geofoam is a registered trademark of Minova International Limited United Kingdom. Materials having physical characteristics of: density less than 5 pounds per cubic foot, compressive strength greater than 2 psi, and a flexural strength greater than 10 psi can be utilized. These materials will hereinafter be referred to as "lightweight fill material". The liner will typically be High Density Polypropylene (HDPE), although other liner materials such as LDPE, PVC, and polyurea composites (e.g. geotextiles coated with polyurea) are commercially available. HDPE liner thicknesses of 30-120 mils would be typically used for the fluid impermeable liner. These materials may be referred to as liner materials or as fluid impermeable liner material. These materials typically have physical characteristics of: yield strength greater than 60 pounds per inch (per ASTM D 6693), puncture resistance greater than 45 pounds (per ASTM D 4833), and are stabilized for protection against ultraviolet sun damage. A textured surface is available on many liner products and would be desirable in this application, specifically as the textured surface increases the coefficient of friction against any surface the liner is in contact with.

The lightweight fill material has a structure. The structure's cross sectional shape would typically be triangular, with approximately 45 degree interior slope and a vertical face on the exterior face. Other shapes, however, are not excluded. The height and width of the structure can vary to fit the physical limitations of the specific installation and are limited by the physical strength of the liner and lightweight fill material, the fluid being contained, and the characteristic of the underlying berm. It will be appreciated that berms are engineered structures with load limits. A typical installation would be no more than 6 feet tall although taller installations are possible.

The basic installation on an existing earthen berm with an existing impervious HDPE liner system would entail the following activities.

1. Excavation of an anchor trench at the berm crest (or ground surface) for the new liner that will enclose the Light weight fill material
2. Cleaning the existing primary liner.
3. Temporarily placing the new liner along the berm crest.
4. Attach the new liner to the existing liner by extrusion weld or other adhesive or mechanical methods.
5. Layback new liner to allow placement of Light weight fill material.
6. Placing Light weight fill material along the berm crest (ground surface).
7. Flip liner over the light weight fill material and install outside edge into anchor trench.
8. Backfill anchor trench.

Another aspect of the disclosure relates to partially enclosing the lightweight material with a liner material that is embedded and anchored into natural grade (ground surface) or an existing earthen berm. In this case the earthen anchor trench will provide the required tensile connection to the liner that is required to prevent movement or overturning of the lightweight fill material. The anchor trench can be specifically designed to optimize the liner embedment into the existing soils in order to maximize the impervious characteristics of the subgrade portion of the assembly. The liner can partially act as an embedded cutoff wall when installed vertically into an anchor trench.

Another aspect of the disclosure is that it provides flexibility in the application of the liner material. Any material that provides the necessary strength to resist overturning and movement of the lightweight fill material (hereinafter "lightweight fill material") could be utilized in order to vary the durability, appearance, and design life of the system. One embodiment of this flexibility would be the application of shotcrete over an impervious HDPE liner. Shotcrete is concrete conveyed through a hose and pneumatically projected at high velocity onto a surface. Shotcrete undergoes placement and compaction at the same time due to the force with which it is projected from the nozzle. It can be impacted onto any type or shape of surface, including vertical or overhead areas The shotcrete would provide a concrete protective layer to protect the assembly from vandalism, accidental impacts, and prevent UV damage to the HDPE liner. This level of protection would be desirable in publicly accessible areas or areas without controlled access, such as public flood control levees. Traditional cast in place concrete or precast concrete panels could also be utilized to provide alternate armoring systems and vary the visual appearance of the system.

Another aspect of the disclosure relates to its minimal weight when compared to traditional methods of constructing berms or raising berms. Traditional methods of raising berms require the addition of structural fill, construction of concrete foundations and wall systems, or the installation of a container to hold a material of sufficient weight to resist the lateral fluid pressures imposed by the retained fluid. This additional weight, in some instances could not be supported by the underlying foundation soils, e.g., the load exceeds the engineered limits of the existing. This makes traditional methods impossible to implement. The disclosed structure and method eliminates these weight concerns as the liner material provides the structural capacity required to resist the lateral fluid pressures. The system does not rely on fluid pressure or the weight of the fill material or contained fluid to seal the liner to the existing soil or to other sections of the liner.

BRIEF DESCRIPTION OF THE DRAWINGS

The accompanying drawings, which are incorporated in and constitute a part of the specification, illustrate preferred embodiments of the disclosure. These drawings, together with the general description of the disclosure given above and the detailed description of the preferred embodiments given below, serve to explain the principles of the disclosure.

FIG. 1 is a typical cross section of a reservoir constructed by excavating the inner portion of the pond below natural grade and utilizing the excavated material to construct earth embankments. The top of the embankment is shown in FIG. 2.

FIG. 2 is a typical cross section of an embankment with two layers of impervious liners (double lined levee). Also shown are two anchor structures for retain the flexible impervious liners.

FIG. 3 shows Embodiment A of the disclosure where the new impervious liner is joined to an existing liner. A former anchor is illustrated with two additional anchors. The anchors may be trenches dug in the top of the ground berm and filled with additional earth, gravel or concrete.

FIG. 4 shows a typical cross section of an existing earthen levee (berm) constructed of compacted soil material.

FIG. 5 shows Embodiment B of the disclosure where the new impervious liner is anchored into existing soil. In this embodiment, the liner may be buried in one or more trenches dug in the top of the earthen berm.

FIG. 6 shows a typical cross section of Embodiment B, with the addition of an armored surface composed of concrete placed over the added berm material.

FIG. 7 shows a typical section of Embodiment C, where the armored surface acts as the impervious liner. The armored surface contains the added shaped berm layer. Footers may also be installed to support the armored layer.

FIG. 8 shows Embodiment D of the system in which the impervious liner 11, is extended to the interior of the berm and is continuous with, and acts as the primary liner for the entire pond. Also shown is a mechanical anchor to secure the added berm material to the earthen berm surface.

FIG. 9 shows the light weight fill material bonded to a concrete foundation as a means of anchoring the system (added berm material and imperious liner) against lateral movement towards the interior (fluid side of the berm surface).

FIG. 10 shows Embodiment E of the system which incorporates a multitude of individual lightweight fill blocks to form a singular larger block. The embodiment shows multiple mechanical anchors assisting in securing the fill blocks together. Trenches are shown for anchoring the impervious liner.

FIG. 11 illustrates an embodiment wherein the lightweight fill material is supplemented with a preformed higher density mass that fits within an indentation of the fill material structure. The higher density mass may extend across a plurality of light weight material sections.

FIG. 12 illustrates an embodiment wherein the lightweight fill material is anchored by soil or other fill material on both sides of the structure. Also the slope of the berm is extended at least a portion of the material structure. An anchor structure is also shown on the back side (non fluid side) of the berm.

FIG. 13 illustrates an embodiment where the lightweight fill material is anchored by the impervious liner and the liner is anchored by a trench constructed on both sides of the lightweight fill material structure.

FIG. 14 illustrates a cross section of an interior berm, i.e., a berm with contained fluids on each side. Elevation of this structure requires bonding of the new liner to an existing liner on each side of the lightweight fill and introduces unique structural load situations and/or constructability requirements. In this embodiment a double layers of a fluid impervious liner may be used with the inner anchored in a trench dug in the top of the berm surface and the outer liner layer covering the trench surface.

FIG. 15 illustrates a side view of a solid wall hollow structure 34, e.g., a pipe, placed on the top of the berm 15. The circular cross section of the pipe structure is used to elevate the height of the berm. A shallow trench 15A may be excavated along the top of the berm. The curved exterior surface 34A of the pipe 34 can be placed into the trench, thereby holding the pipe laterally in position. This can facilitate holding the pipe in position at the top of the berm against possible horizontal lateral force of the elevated liquid. Supplementing this is the fill material 27 positioned against the front and back sides of the pipe. Also shown is the use of the extended retainer liner 11 to hold the pipe in position. The liner can be tautly held to press the pipe downward. The liner is thereby part of the retainer of the solid wall hollow structure 34. An end of the liner 11 is anchored by placement in a trench 14.

FIG. 16 illustrates a side view of a solid wall hollow structure 34, e.g., a pipe placed on the top of the berm 15. Illustrated is an optional trench 15A to hold the pipe in position on the berm. Also illustrated is the liner 11 extending over the top of the pipe. The liner may be under tension and therefor operates as a structural component to hold the pipe in a fixed position against the lateral force of the liquid. FIG. 16 shows the contour of the bottom section of the pipe wall 34A fitting into the trench 15A. Also illustrated is the placement of fill 27 on a front and back side of the solid wall hollow structure 34.

FIG. 17 illustrates another embodiment where a lightweight structure comprising a solid body hollow structure is positioned upon the top surface of a berm. The structure serves as an elevated barrier above the top of the berm. Here the structure comprises a plurality of solid flat sides. This allows the positioning of additional structures at the top of the lightweight structure for further elevation above the top of the berm. Again the structure can be covered by an extension of the liquid impenetrable liner over the structure. Note the structure may contain a plurality of internal struts to strengthen the structure.

DETAILED DESCRIPTION AND SPECIFIC EMBODIMENTS

It will be appreciated that not all embodiments of the disclosure can be disclosed within the scope of this document and that additional embodiments of the disclosure will become apparent to persons skilled in the technology after reading this disclosure. These additional embodiments are claimed within the scope of this disclosure.

It should be noted that each installation of this system will present unique engineering challenges that will require customization of the system. These may include, but are not limited to, provision of personnel access routes, pipe penetrations, and custom fitting around existing structures. These are impossible to predict and will vary with the existing conditions and equipment at the individual installation locations. The scope of the Applicant's disclosure is adaptable to each unique engineering challenge by combination of the disclosed systems.

It will be appreciated that retention ponds do not experience a liquid current. The disclosure, however, is also applicable to levees retaining flowing liquid, e.g. water. A current creates a force parallel with the face of the lightweight fill material, i.e., the surface of the lightweight fill material facing the liquid. A current may also be experienced at the inlet or outfall of a retention pond. In such applications, it may be advantageous to utilize anchors that penetrate the lightweight fill materials and extend into the soil comprising the berm. An example of this is shown in FIG. 8. In another embodiment, FIG. 7 shows a concrete layer in front of the lightweight fill material. In one embodiment, the concrete layer faces only the liquid.

FIG. 1 is a cross section of an existing reservoir that demonstrates a potential application of the system. This type of reservoir is typically constructed by excavating an area 21, below the existing ground surface of the site. This excavated material may be utilized to construct the berm 1, if it is of suitable geotechnical characteristics, or may be disposed of in another location. The berm 1, may also be constructed of imported fill material of suitable characteristics. The fluid surface 2, is shown for reference. The fluid surface 2, cannot become higher than the top elevation of berm 1. If fluid surface 2 overtops berm 1, significant damage and potential catastrophic failure of the berm can result. Existing surface grade surrounding the berm 3, is shown for reference. Dimension 4 represents the total footprint of the reservoir formed by the berm. This dimension is often constrained by adjacent structures, utilities, or property lines and cannot be increased. It is also expensive to construct earthen berms. In a scenario where dimension 4 is constrained, there are limited options to raise the height of berm 1 as the berms have been designed per specific slope stability calculations and an increase of weight caused by adding fill or heavy barriers to the crest of berm to increase the berm height could affect the slope stability or the underlying existing surface 3 to create an unstable geotechnical condition. (See also FIG. 4.)

FIG. 2 shows a typical cross section of a berm crest that has a double liner system installed. The fluid surface 2 is shown for reference. The distance between the fluid surface 2 and the crest of the berm is shown as dimension 10, commonly referred to as freeboard. Freeboard heights are sometimes regulated by government agencies to provide additional storage capacity for extreme rainfall events, system failures, or other events that could quickly increase the elevation of the fluid surface and result in overtopping of the berm 1. In an embodiment, the lightweight fill material subject of this disclosure (positioned on top of the berm) may comprise the required freeboard. (See FIG. 3)

The double liner is typically installed in instances where little or no leakage of the liquid is desired or permitted by law. The double liner consists of a Primary Liner, 7 that is the primary impervious layer in the system. Liner 7 is typically terminated in an anchor trench 6A, placed along the berm crest. The anchor trenches 6A and 6B are engineered to provide adequate soil mass to prevent pullout or displacement of the respective liners 7 and 9 and can also anchor the drainage layer 8. The Primary Liner may be the top liner of the double liner system. Two anchor trenches 6A and 6B are shown. One anchor trench 6B may be used to secure the Secondary Liner. The anchor trench stabilizes the liner against displacement and is typically backfilled with compacted soil. Secondary Liner 9, provides a backup impervious liner and enables installation of leak detections systems to determine the quantity of leakage through the primary liner. A drainage layer 8, is typically installed between liners 7 & 9 to cushion and protect the primary liner and to provide means for leakage through the primary liner to be directed and collected in a leak detection system. The drainage layer can be constructed of a sand layer or a synthetic material such as a geonet.

Liners 7 & 9 are typically constructed of High Density Polypropylene (HDPE), Low Density Polypropylene (LDPE), Polyvinyl Chloride (PVC), poly urea composites, or polyethylene. They are installed to form a continuous liner in the reservoir.

This double liner system presents challenges to any attempt to raise the height of the existing levee as the integrity of the anchor trenches and liners must be preserved to maintain the system.

FIG. 3 shows Embodiment A of the proposed system. The drainage layer 8 is omitted from this view for clarity. A new anchor trench 14, is shown along the exterior edge of the proposed system. The new anchor trench is installed along the existing berm crest in a manner that does not disturb (or minimally disturbs) the existing anchor trench, 6A. A lightweight fill material 12, is shown placed along the berm crest. This lightweight fill material forms the structural core of the extended berm height system. The lightweight fill material is typically installed in lengths that are 8-10 feet long (sections) and do not require direct attachment to each other. The light weight fill material may be constructed of a foam type material as described previously. A new liner 11, partially encloses the fill 12, and is attached to the existing liner 7, by mechanical bonding, welding, adhesives or mechanical fastening at point 13. The attachment must provide sufficient strength to join the two liners and secure the position of the lightweight fill material. The attachment must also be fluid impervious to maintain the integrity of the liner system. The combination of liner 7, and the attachment point 13, and anchor trench 14, form the structural anchor system that enables the lightweight fill to adequately resist the fluid pressure 22, which results from the fluid elevation 2 acting upon the structure. Items 7, 13, and 14 (liner, liner attachment point, and anchor trench) also form the means of joining the system into a continuous structure. The system eliminates the need for directly connecting the lightweight fill material sections. This method does not disturb the secondary liner 9 or its anchor trench 6B.

FIG. 4 shows a cross section of a typical earthen berm. Berms are commonly constructed of compacted earth fill 15. The compacted earth fill is of suitable geotechnical characteristics to contain the fluid and maintain the structural integrity of the berm against hydrostatic pressures. These berms may be constrained by the underlying foundation soils. There may be instances where the bearing capacity of the foundation soils limits the weight (and therefore the height) of the levee to be constructed on top of the foundation soils. The height can also be constrained by the available footprint of the berm, shown as dimension 23. The interior slope 24A and exterior slopes 24B of the berm, are limited in their degree of steepness by the soil characteristics of the earth fill 15. This slope limits the height within the footprint 23. The berm crest 25, is typically limited to how narrow it can be due to constructability of the berm itself as related to equipment access during construction. The berm crest may also facilitate installation of equipment, roadways, pedestrian paths, or routes for inspection of the berm.

FIG. 5 shows Embodiment B of the disclosure. In this version, the new anchor trenches 14A and 14B, are utilized to anchor the impervious liner, 11 into the existing soil. Note that this existing soil (compacted earth fill 15) may be part of an existing berm 1 or could be natural grade in instances where a berm does not exist. The lightweight fill material 12, forms the structural core of the system while the liner 11, and anchor trenches 14 form the system that anchors the system and provides the impervious nature of the system. This embodiment could provide economical means of effectively raising the height of an existing berm, or facilitate the construction of a levee where none existed previously. This embodiment is unique in that it does not require an existing impervious liner to be present. In this embodiment, the liner could be, but is not limited to the materials discussed above such as HDPE, LDPE, PVC, poly urea, or polyethylene. In one embodiment, the impervious liner has tensile strength of 168 pounds per inch and puncture resistance of 90 lbs.

FIG. 6 shows a version of embodiment B with the addition of an armored facing (protective structure 17). This version would be desirable for use in areas where protection against fluid flow, vandalism, impact, or UV degradation of the liner material was desirable. In this version the anchor trenches 14A and 14B, lightweight fill 12, and impervious liner 11, are installed in the same manner as above. A protective structure 17 could be installed by placement of a reinforcing steel 16 (Welded Wire Fabric or Rebar) along the liner 11. Concrete could then be placed over the liner and enclosing the reinforcing by means of shotcrete placement, where concrete is sprayed onto a structure. Shotcrete is, in effect, a version of a cast-in-place concrete wall. Rather than placing concrete into forms, however, a fresh mix is sprayed onto wall panels that have been erected in the shape of the structure. Concrete is applied from a pressurized hose to encompass the reinforcement and build up the wall thickness, forming structural shapes that include structural shape or assemblies. These can be constructed over the lightweight fill material. Polystyrene is a common surface for accepting fresh concrete. This method of concrete placement is well known in the industry, and is only one example of how concrete could be placed for protection of the system. The concrete structure 17, would ideally extend below grade to provide additional protection.

FIG. 7 shows embodiment C of the system in which the protective structure 19A, 19B, and 19C would be installed in sections and joined sealed together at the joints with sealant 20A and 20B, to form the impervious liner. This method demonstrates the use of an alternate material to anchor the lightweight fill and provide the impermeable liner. As it would require the installation of foundations 18A and 18B, and either the fabrication of the armor panels 19A-19C or the utilization of cast in place concrete, it is envisaged that this embodiment would not be as economical as other embodiments. In this embodiment, the protective armor could feasibly be any material which would be of impervious nature, of sufficient structural strength, and incorporate the ability to be joined together to create impervious joints.

FIG. 8 shows Embodiment D of the system in which the impervious liner 11, is extended to the interior of the berm and is continuous with, and acts as the primary liner for the entire pond. This embodiment would be typical of using the system in a newly constructed pond, without the need to bond or join the liner 11 to an existing liner 7, as shown in FIG. 3. In this embodiment, the addition of a mechanical anchor 26, would be desirable to anchor the lightweight fill 12, in instances where the reservoir was empty and the liner would have no fluid pressure acting to prevent movement of the system towards the pond interior.

As an alternate to the mechanical anchor, the foam could be bonded adhesively or mechanically to a concrete foundation or other rigid material 31 as a means of anchoring the system against movement towards the interior. This detail is shown in FIG. 9. The rigid material 31, would lock the lightweight fill into place and prevent movement towards the pond interior as a result of an external force such as wind or impact. This configuration would also provide additional resistance to overturning due to the weight of the rigid material. The rigid material could be buried and mechanically anchored to the lightweight fill.

FIG. 12 shows a further embodiment of FIGS. 8 and 9, wherein an arrangement with a soil anchor point 27 is created, on both sides of the lightweight fill 12. This detail shows the soil on the inner face of the lightweight fill extending along the face of the lightweight fill to anchor the block and to provide a continuous interior slope 30, against which to place the impervious liner 11. This arrangement may be desirable to better anchor the lightweight fill in Embodiment D of the system. The soil anchor point 27, could be installed on one side only, and the cross section and shape of the soil anchor could vary according to the unique properties of each installation.

FIG. 13 shows another arrangement of Embodiment D, in which an anchor trench 14A and 14B, is installed on both sides of the lightweight fill material, 12. This arrangement would fully anchor the lightweight fill against lateral movement. It would also provide the benefit of a traditional anchor trench for the impervious liner 11. This may be desirable in instances where the forces exerted by the liner (due to thermal expansion/contraction) may be greater than the resistance available by the lightweight fill 11, and the previously mentioned mechanical anchors, 26. An anchor trench cover 32 may be desirable to prevent erosion and saturation of the interior anchor trench 14 by the contained fluid. The anchor trench cover 32 could be constructed from the same material as the liner 11 and attached by mechanical, welding, or adhesive means to the liner 11. The anchor trench cover 32 could be an alternate type of liner or a thinner section of liner, as it will likely not function as a structural member.

In another embodiment illustrated in FIG. 14, the system may be installed on an interior berm. An interior berm is defined a berm with contained fluids on each side, as would be the case in a berm dividing a larger basin into two separate basins. This situation could present a situation that would require bonding of the new liner 11 to an existing liner 7 on each side of the lightweight fill and introduce unique structural load situations or constructability requirements. One alternative in this situation is to install the primary liner 11 embedded into anchor trenches 14A and 14B in order to provide structural integrity to the system. A containment liner 33, would then be bonded (adhesively or mechanically) to the existing liner on either side of the system. This liner 33, could also be bonded to the liner 11 in order to provide additional strength and prevent liner movement in the wind. The new anchor trenches 14A and 14B may need to be constructed in a way to minimally disturb existing anchor trenches 6A and 6B.

FIG. 10 shows Embodiment E of the system that incorporates a multitude of individual lightweight fill block sections to form a singular larger block. The individual blocks 12, would be joined via mechanical anchors 28, which are commercially available and typical to the installation of multiple layers of Light weight fill material blocks. The height of this system would be limited by the strength of the liner material 11, the strength of the anchor trenches 14A and 14B, and potentially the strength of the lightweight fill material. This embodiment could also be utilized as in FIG. 3, where the liner 11 is connected to an existing liner 7, or as shown in FIG. 8 where utilized with a continuous liner. The downward force applied by the liner material will act to compress the blocks together and cause them to act as a singular block in conjunction with the mechanical anchors. As an alternative to the mechanical anchors 28, the blocks 12, could be joined together with a compatible adhesive. This adhesive would cause the individual blocks to act as a singular block. In another embodiment, (not shown) the individual block sections could be over lapped across the lower joints of two separate section, thereby increasing the structural unity of the length of multiple block sections comprising the lightweight fill material.

Embodiment A (FIG. 3) could be constructed to allow the addition of a leak collection and detection system in between the existing primary liner 7 and the new liner 11. This could be required to satisfy certain regulatory requirements or provide a means of monitoring the integrity of the attachment point 13. A leak detection system could be provided for any of the embodiments. A leak detection system is traditionally constructed of perforated pipe (typically PVC or HDPE) installed to collect any fluid that leaks from the containment system, in this case, through liner 11 or attachment point 13. The collected fluid is routed to a collection sump where it can be monitored or pumped back into the containment area.

Embodiment A could also be constructed by adding a second impervious liner over liner 11 and providing an additional attachment point to the existing liner and an installing the second liner into the anchor trench 14.

Embodiment E or B (FIG. 10 or 5) could be constructed also with the addition of a second impervious liner over liner 11 and the addition of a new anchor trench on each side of the system. This would provide a secondary liner and provide additional safety factor into the strength of the system against overturning.

FIG. 11 shows Embodiment F of the system that incorporates a high mass insert to provide additional resistance to horizontal displacement and overturning of the system. In this embodiment the weight of the lightweight fill material structure is supplemented by the addition of more dense material. The high mass insert 29, could be constructed of any material of sufficient density to provide the required resistance to displacement or overturning. This supplemental mass can be concrete poured and cured in a mold wherein the shape of the mold is complementary to an indentation formed within the structure of the lightweight fill material. Materials such as sand bags, geo-tubes, and steel shapes, would be examples of materials also available. As this method would require the use of additional materials, it is envisaged that this embodiment would not be as economical as other embodiments. It will be appreciated that the lightweight fill material is transported and positioned at the berm crest without the supplemental weight. The weight can be added after the structure is in position. In one embodiment, the weight may be less than 100 lbs. and manually positioned into the structure. It will be appreciated that a structure can have multiple indentations to receive the supplemental weight. The advantage of this system will be to allow the structure to have increased mass without requiring mechanical equipment, e.g., mechanical lifting equipment or carrying equipment, to be brought to the site. (The supplemental mass may be manually placed within the structure.) It will be appreciated that access to the site of the berm may be restricted. Illustrated are the lightweight fill material structure 12 and the supplemental mass 29 fitting into an indenture of the fill structure. The high mass insert 29, could be anchored or bonded to the lightweight fill material 12. Also illustrated is the anchoring trench 14 containing the end of the liner 11 that is placed over the fill structure and continues to cover the inner surface of the berm.

In another embodiment, the lightweight fill sections can be joined together end to end. This is particularly useful when the lightweight fill material comprise sections of expanded polystyrene (EPS) or a similar lightweight rigid foam plastic material. The lightweight fill material (components or sections) are prefabricated offsite into selected shapes. Each section can be between 6 and 30 feet in length. Other dimensions are possible. The sections can be variable in height. The lower portion of the section can be broader than the upper section to enhance stability. The sections can be placed end to end on the berm crest.

The ends of the lightweight fill material sections can be joined together. This can be accomplished by inserting rebar into each end or using commercially available anchors as in embodiment E. In one embodiment, the length of rebar inserted into each section can be 4 to 24 inches. The rebar can be precut, thereby facilitating prompt assembly in the field. Each juncture can be linked together by multiple sections of rebar. It will be appreciated that the linking together of each component will prevent one component or section of lightweight fill material from being pushed out of line, causing a gap to form in the extended height berm subject of this disclosure. The rebar can be fitted into indentations or holes within section ends of the lightweight fill material. It will be appreciated that the length of the rebar section, preferably greater than 20 inches, will improve the stability of the junction between two sections of the lightweight fill material. The greater unified length of the lightweight fill sections will protect against a localized surge in fluid level and help to facilitate construction by anchoring the lightweight fill material sections together prior to anchoring them by enclosing them with the liner 11. Multiple lightweight fill sections could also be joined together using continuous steel cables inserted lengthwise through preformed penetrations in each section of the lightweight fill material. This steel cable could be mechanically anchored to the existing berm to provide additional structural stability. The cable diameter, material of construction and spacing of the mechanical anchors would depend on the specific design parameter of each installation.

In another embodiment, the ends of each lightweight fill material are modified in the manufacturing process to create male and female protrusions and indentations at each end. Therefore one end of the lightweight fill component would contain a male protrusion and the other end would contain a female indentation. The indentations and protrusions would be complementary dimensioned to allow the male end of a first component to fit into the female end of a second component. As with the joining the ends with rebar, the joined sections of lightweight fill material would prevent one section from being pushed back. In both cases (rebar linkage or male/female end coupling), the series of lightweight fill material would act as a unified structure or barrier.

In another embodiment the lightweight fill materials completely surround a retention pond. Therefore the ends of each section of lightweight fill material abut the end of another section. In another embodiment where the lightweight fill material forms a levee structure, the series of sections of lightweight fill material may end where the ground level exceeds a specified elevation. The end section may be dug into the ground at the point that the ground level exceeds the specified elevation. This would serve to anchor the end of the section linked in accordance with the above disclosure.

In another embodiment of the invention, the height of a liquid retention pond may be elevated by placement of lightweight structures on top of an existing berm. The structures can be solid wall with hollow internal structures. It will be appreciated that this structure is different from the rigid lightweight foam structures discussed above. This embodiment utilizing solid walls with hollow internal structures can allow utilization of pre-existing construction material. For example, manufactured hollow plastic pipes can be used. For example, this could be 36 inch diameter HDPE pipe. The ends of the pipe ends can be joined together to form a liquid impenetrable barrier. The barrier can extend the entire length of the berm.

Looking at FIG. 15, the liquid impenetrable properties of the HDPE pipe 34 can be enhanced by also using the liquid impenetrable properties of the berm liner 11. The liner extends from the bottom of the pond up the slope of the berm. The liner 11 continues over the top surface of the pipe structural element 34. The liner is buried within fill material (anchor trench) 14 at the top of the berm. The liner is taut, thereby serving as a structural element holding the pipe element down against the surface of the berm.

FIG. 15 also illustrates the Applicant's Embodiment G of the system in which the previously described lightweight fill material 12 is replaced with a hollow structural element 34. See FIG. 14 illustrating the position of the lightweight fill material. The structural element illustrated in FIG. 15 could be of any shape, but commonly available circular shapes would be the most common, for example, pipe made of PVC, HDPE, steel, or concrete. The solid section of the structural element would have a density greater than 5 pounds per cubic foot, a compressive strength greater than 200 psi, and a flexural strength greater than 20 psi. The overall cross section density of the element would be less than 62 pounds per cubic foot (buoyant in water). Since the overall cross sectional density of the element is less than the density of the retained liquid, the structural element would not be stable against lateral pressure forces from the retained fluid and the structural element would be buoyant—it would float. As in the previous embodiments, i.e., FIGS. 3, 5, 6, 8, 10, and 11, the structural fill would be anchored against buoyant and lateral forces by the impervious liner 11. In the embodiment of FIG. 15, a soil anchor point 27 is utilized to further secure the structural element 34. The liner 11 is secured in an anchor trench 14. The hollow structural element has a fixed shape and form like the lightweight fill material, and is not filled with soil or material of similar density to be secured against lateral and buoyant forces.

FIG. 16 illustrates another embodiment for extending the height of a berm surrounding a retention pond. FIG. 16 illustrates a cross sectional view of a berm 36 and a lightweight extension or fill material 34. In this instance, the extension material may be a pipe positioned horizontally parallel to the height of the top of the berm. The lightweight height extension material can be a plurality of solid wall hollow structures. The solid wall hollow structures may be positioned end to end forming continuous and liquid tight pipe connections extending along the top of the berm. These structures can be installed upon the top of a berm. These structures may be anchored to the berm structure. The anchoring mechanisms may be screw augers. The anchors may also comprise the end of a liner material 11. In one embodiment, the liner may be an extension of the liner that covers the bottom and sides of the retention pond and side walls. The liner 11 may be extended so that it covers the solid wall hollow structure 34. The liquid impermeable solid wall structure is held in place by the liner. The liner is held in place using placement of the liner within a excavated portion of the berm and backfiling material 14A, 14D over the liner. The embodiment illustrated in FIG. 16 also shows the use of fill material 27 placed on each side of the piped apparatus to hold the apparatus in a lateral position. This strengthens the positioning of the pipe section against lateral movement of the liquid over the berm. The structure is supported by the excavation and back fill 14B, 14C.

FIG. 16 illustrates an embodiment of the system in which the previously described lightweight fill material 12 is replaced with a solid side hollow structural element 34. This structural element could be of any shape, but commonly available circular shapes would be the most common, for example, pipe made of PVC, HDPE, steel, or concrete. The solid wall section of the structural element 34 would have a density greater than 5 pounds per cubic foot, a compressive strength greater than 200 psi, and a flexural strength greater than 20 psi. The overall cross section density of the structural element would be less than 62 pounds per cubic foot (buoyant in water). Since the overall cross sectional density of the element is less than the density of the retained liquid, the structural element would not be stable against lateral pressure forces from the retained liquid and the structural element would be buoyant—it would float. As in the previous embodiments, the structural element would be anchored against buoyant and lateral forces by the impervious liner 11 and soil anchor points 27. The structural element 34 may also be secured by mechanical anchors 35. The mechanical anchors could be sections of impervious liner, soil anchors, engineered fabric such as geotextile or geogrid, or other methods of mechanical attachment. The additional anchoring 35 may be desirable to provide additional protection against impact forces or other external loads. The embodiment illustrated in FIG. 16 shows the use of mechanical anchors 35 secured in anchor trenches 14B and 14C. The impervious liner 11 may be secured in anchor trench 14A.

These solid wall hollow structures can have a round, oval, square, rectangular, triangular or polynomial cross sectional shape. The outer surface of each shape is solid and therefore creates a liquid barrier. The interior of the structure is hollow.

In one embodiment, the round cross sectional structure can be a pipe. The each pipe segment can be joined or attached to the next pipe segment. The joined or attached pipe segments can create a liquid tight connection. The pipe sections may thread together, e.g., one pipe segment for a female threaded coupling that fits over a male complementary threaded structure of the next pipe segment. In another embodiment, the adjacent ends of the pipe segments may be glued together to form a liquid tight connection. This "gluing" may utilize PVC cement.

In another embodiment, the solid wall hollow structures can incorporate reinforcing internal bracing components. This is illustrated in FIG. 17. These reinforcing internal bracing components 37 can strengthen the structure against the compressive force of the retained liquid exerted upon the exterior surface 36 of the structure. This compressive force will act upon the retention structure in a horizontally oriented direction.

FIG. 17 illustrates another embodiment where a lightweight structure comprising a solid body hollow structure is positioned upon the top surface of a berm. The structure serves as an elevated barrier above the top of the berm. Here the structure comprises a plurality of flat sides 36. This allows the positioning of additional structures a top the lightweight structure for further elevation above the top of the berm. Again the structure can be covered by an extension of the liquid impenetrable liner 11 over the structure. The liner positioned over the structure is anchored at each side of the structure by burying the ends of the liner and back filling 14 the liner.

This reinforcement internal bracing components by be particularly helpful against the crushing compressive force impacting square or rectangular shaped solid wall hallow shaped structures comprising square or rectangular shapes.

In a preferred embodiment, the square or rectangular cross sectioned solid wall hollow body contains only internal bracing. This permits multiple solid wall hollow body structures to be stacked on top of each other, there by increasing the height that the liquid retention structure can be raised. It may be desirable for the stacked structures to have male and female indentations to lock together as they are stacked. This is not possible with other structures that incorporate braces or frames that extend outside the surface of the solid wall hollow structures.

It will be appreciated that the Applicant's disclosure does not require bracing or support components extending outside the solid wall hollow body retention structure that can be placed a top of the retention berm.

This specification is to be construed as illustrative only and is for the purpose of teaching those skilled in the art the manner of carrying out the disclosure. It is to be understood that the forms of the disclosure herein shown and described are to be taken as the presently preferred embodiments. As already stated, various changes may be made in the shape, size and arrangement of components or adjustments made in the steps of the method without departing from the scope of this disclosure. For example, equivalent elements may be substituted for those illustrated and described herein and certain features of the disclosure maybe utilized independently of the use of other features, all as would be apparent to one skilled in the art after having the benefit of this description of the disclosure.

While specific embodiments have been illustrated and described, numerous modifications are possible without departing from the spirit of the disclosure, and the scope of protection is only limited by the scope of the accompanying claims.

What I claim is:

1. An impermeable liquid retention barrier expansion system comprising:

a) one or more rigid barrier structures having a surface at least partially positioned on a ground or berm surface wherein the rigid barrier structures have a cross sectional rigid width and rigid height;

b);

c) the barrier structure supports a part of a first liquid impermeable liner wherein a first edge of the first liner is attached to an edge of an existing second liner of the existing retention system and the first liner covers a first side of the barrier structure and continues over the top of the barrier wherein a second edge of the first liner is positioned into the ground surface proximate to a second side of the barrier structure; and d) the first liquid impermeable liner is tautly configured to secure the barrier structure in a fixed position to resist fluid and wind forces.

2. The liquid retention barrier system of claim 1 wherein the attached edges of the first and second liner form a liquid impermeable seal.

3. The liquid retention barrier system of claim 1 wherein a portion of the first liquid impermeable liner is secured in an anchor trench.

4. The liquid retention barrier system of claim 1 wherein the rigid barrier structure contains a hollow internal structure.

5. The liquid retention barrier system of claim 4 wherein fill material may be added into the hollow internal structure.

6. The liquid retention barrier system of claim 5 wherein lightweight foam material having a density less than 5 pounds per cubic foot, compressive strength greater than 2 psi, and flexural strength greater than 10 psi is added into the hollow internal structure.

7. The liquid retention barrier system of claim 4 wherein lightweight foam material having a density less than 5 pounds per cubic foot, compressive strength greater than 2 psi, and flexural strength greater than 10 psi is positioned under the liner and on the ground or berm surface adjacent to the exterior side portion of the rigid barrier structure added into the hollow internal structure.

8. The liquid retention barrier system of claim 1 wherein a first barrier lower structure comprises at least one shaped surface thereby allowing a second barrier structure to be stacked vertically above a complementary shaped upper surface of the lower first barrier structure.

9. The liquid retention barrier system of claim 1 wherein fill material can be added adjacent to or within the barrier structure.

10. The liquid retention pond barrier system of claim 9 wherein the liner encloses fill material.

11. The liquid retention barrier system of claim 1 wherein the first liquid impermeable liner is secured in an anchor trench on each side of the rigid barrier structure.

12. The liquid retention barrier system of claim 1 wherein the first liquid impermeable liner is liquid impermeably attached to the top surface of the second impermeable liner.

13. A liquid retention barrier system comprising:

a) a hollow rigid cylindrical structure positioned on a ground surface or berm;

b) a liquid impermeable liner positioned into the ground or berm surface or bonded to an existing liner and tautly positioned above and across of the width and height of the hollow rigid cylindrical structure; and c) the taut impermeable liner structured to securely hold the hollow rigid cylindrical structure in a lateral position on the ground or berm surface.

14. The liquid retention barrier system of claim 13 further comprising fill material positioned between the liner and cylindrical structure wherein the liner is positioned above and across the width and height of the cylindrical structure.

15. The liquid retention barrier of claim 13 further comprising a first liner positioned over the cylindrical structure and anchored to the berm or ground surface, a second liner also positioned above and across of the width and height of the hollow rigid cylindrical structure and the second liner anchored in a different position than the first liner and fill material positioned between the first liner and a second liner.

16. A liquid retention barrier system comprising:

a) a hollow rigid cylindrical structure positioned on a ground surface or berm;

b) a liquid impermeable liner positioned into the ground or berm surface or bonded to a previously existing liner and tautly positioned above and across (i) the width and height of the hollow rigid cylindrical structure and (ii) fill material positioned on the ground or berm surface adjacent to at least one side of the hollow rigid cylindrical structure; and c) the taut impermeable liner and the fill material structured to securely hold the hollow rigid cylindrical structure in a lateral position on the ground or berm surface.

17. A liquid retention barrier system comprising:

a) a hollow rigid cylindrical structure partially positioned in a recess into a ground surface or berm;

b) a liquid impermeable liner positioned into the ground or berm surface or bonded to a previously existing liner and tautly positioned above and across the width and height of the hollow rigid cylindrical structure; and c) the taut impermeable liner structured to securely hold the hollow rigid cylindrical structure in a lateral position on the ground or berm surface.

18. A liquid retention barrier system comprising:

a) a hollow rigid cylindrical structure positioned on a ground surface or berm;

b) a liquid impermeable liner having a yield strength of at least 60 pounds per square inch and puncture resistance of at least 45 lbs c) the liquid impermeable liner positioned into the ground or berm surface or bonded to a previously existing liner and tautly positioned above and across the width and height of the hollow rigid cylindrical structure; and d) the taut impermeable liner structured to securely hold the hollow rigid cylindrical structure in a lateral position on the ground or berm surface.

* * * * *